US012698731B2

(12) United States Patent
Rohde et al.

(10) Patent No.: US 12,698,731 B2
(45) Date of Patent: Aug. 4, 2026

(54) VALVE BRIDGE FOR A VALVE TRAIN OF AN INTERNAL COMBUSTION ENGINE, ESPECIALLY OF A MOTOR VEHICLE, AND INTERNAL COMBUSTION ENGINE

(71) Applicant: DAIMLER TRUCK AG, Leinfelden-Echterdingen (DE)

(72) Inventors: Patrick Rohde, Esslingen (DE); Matthias Lahr, Schwabisch Gmund (DE); Andreas Ruess, Leutenbach (DE)

(73) Assignee: DAIMLER TRUCK AG, Leinfelden-Echterdingen (DE)

( * ) Notice: Subject to any disclaimer, the term of this patent is extended or adjusted under 35 U.S.C. 154(b) by 0 days.

(21) Appl. No.: 18/686,317

(22) PCT Filed: Aug. 4, 2022

(86) PCT No.: PCT/EP2022/072022
§ 371 (c)(1),
(2) Date: Feb. 23, 2024

(87) PCT Pub. No.: WO2023/025565
PCT Pub. Date: Mar. 2, 2023

(65) Prior Publication Data

US 2026/0139613 A1 May 21, 2026

(30) Foreign Application Priority Data

Aug. 23, 2021 (DE) ..... 10 2021 004 306.5

(51) Int. Cl.
*F01L 1/18* (2006.01)
*F01L 1/26* (2006.01)

(52) U.S. Cl.
CPC ..... *F01L 1/181* (2013.01); *F01L 1/26* (2013.01); *F01L 2303/01* (2020.05)

(58) Field of Classification Search
CPC ..... F01L 1/181; F01L 1/26; F01L 2303/01
See application file for complete search history.

(56) References Cited

U.S. PATENT DOCUMENTS 8,863,726 B2 * 10/2014 Ruggiero ..... F01L 13/06 123/90.12
2010/0006062 A1 * 1/2010 Yang ..... F01L 13/06 123/321

(Continued)

FOREIGN PATENT DOCUMENTS

DE 112016006466 T5 10/2018
WO 20190228671 A1 12/2019
WO WO-2019228671 A1 * 12/2019 ..... F01L 1/12

OTHER PUBLICATIONS

International Search report for PCT/EP2022/072022 mailed on Dec. 1, 2022.

*Primary Examiner* — Shafiq Mian
(74) *Attorney, Agent, or Firm* — Dennemeyer & Associates LLC

(57) ABSTRACT

The invention pertains to a valve bridge (42) for a valve train (10) of an internal combustion engine, having a bridge actuation area (44), via which the valve bridge (42) can be actuated by means of a first rocker lever (32) of the valve train (10) and can thus be moved in translational motion in a first direction of movement (22), having a first valve actuation area (46), via which, by actuating the valve bridge (42), a first gas exchange valve (18) of the internal combustion engine can be actuated by means of the valve bridge (42), and with a second valve actuation area (48), via which, by actuating the valve bridge (42), a second gas exchange valve (20) of the internal combustion engine can be actuated by means of the valve bridge. The valve bridge (42) comprises a bridge center part (45) forming the bridge actuation area (44), a first bridge part (52) forming the first valve (Continued)

Figure 1:
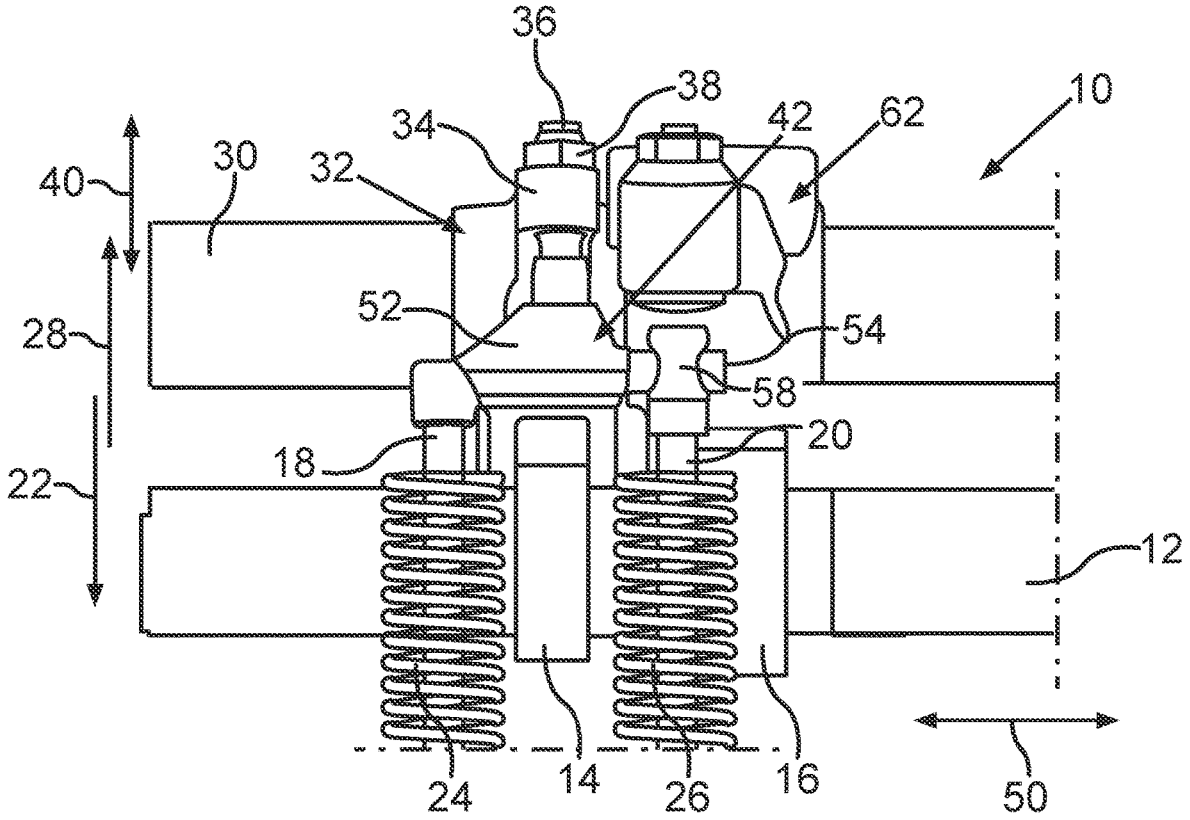

actuation area (46), a guide part (54) projecting from the bridge center part (45) and from the first bridge part (52) along a longitudinal extension direction (50) extending perpendicularly to the first direction of movement (22) and which is movable with the bridge center part (45) and with the first bridge part (52), and a second bridge part (58) formed separately from the bridge center part (45), separately from the first bridge part (52) and separately from the guide part (54), and forming the second valve actuation area (48), the second bridge part having a reception orifice (60) in which the guide part (54) engages.

10 Claims, 3 Drawing Sheets

(56) References Cited

U.S. PATENT DOCUMENTS

2014/0326212 A1* 11/2014 Baltrucki ..... F01L 13/06
123/321
2018/0058271 A1 3/2018 Baltrucki et al.

* cited by examiner

VALVE BRIDGE FOR A VALVE TRAIN OF AN INTERNAL COMBUSTION ENGINE, ESPECIALLY OF A MOTOR VEHICLE, AND INTERNAL COMBUSTION ENGINE

CROSS-REFERENCE TO RELATED APPLICATIONS

This is a 35 U.S.C. 371 National Stage Patent Application of International Application No. PCT/EP2022/072022, filed Aug. 4, 2022, which claims priority to German application 10 2021 004 306.5, filed Aug. 23, 2021, each of which is hereby incorporated by reference in its entirety.

The invention pertains to a valve bridge for a valve train of an internal combustion engine, especially of a motor vehicle, according to the general term of patent claim 1. Furthermore, this invention pertains to an internal combustion engine according to the general term of patent claim 8.

A system for actuating at least one of two motorized valves of a combustion motor is known from U.S. Pat. No. 10,648,371 B2.

The task of the present invention is to create a valve bridge for a valve train of an internal combustion engine and also an internal combustion engine, so it is possible to implement particularly simplified maintenance and/or repair of the internal combustion engine.

This objective can be solved by a valve bridge with the features of patent claim 1 and by an internal combustion engine with the features of patent claim 8. Advantageous embodiments with useful further embodiments of the invention are described in the remaining claims.

A first aspect of the invention pertains to a valve bridge for a valve train of an internal combustion engine, preferably designed as a reciprocating piston engine or reciprocating piston motor and also referred to as a combustion motor, especially of a motor vehicle. This means that the motor vehicle, which is preferably designed as an automobile, in particular as a utility vehicle, comprises the internal combustion engine in its completely manufactured state and can be driven by means of the internal combustion engine. In its completely manufactured state, the internal combustion engine comprises the valve train, which in turn comprises the valve bridge. The valve bridge has a bridge actuation area, via which the valve bridge can be actuated by means of a first rocker lever of the valve train and can thus be moved in translational motion in a first direction of movement. The bridge actuation area is thus designed to interact with the first rocker lever. The first rocker lever is, for example, pivotably mounted on a rocker lever axis and can thus be pivoted about a pivot axis relative to the rocker lever axis. For example, the first rocker lever can be actuated by means of a cam of a camshaft and can thus be pivoted about the pivot axis relative to the rocker lever axis. By pivoting the rocker lever about the pivot axis relative to the rocker lever axis, the valve bridge can be actuated via the bridge actuation area by means of the first rocker lever. The bridge actuation area is thus designed, for example, to convert a movement, especially the pivoting, of the first rocker lever into a movement of the valve bridge in the first direction of movement relative to the rocker lever axis. In other words, the bridge actuation area is designed, for example, to transmit a movement, in particular the pivoting, of the first rocker lever to the valve bridge, as a result of which the valve bridge can be moved or is moved in translational motion relative to the rocker lever axis in the first direction of movement.

In addition to the bridge actuation area, the valve bridge also has a first valve actuation area, via which a first gas exchange valve of the internal combustion engine can be actuated by means of the valve bridge by actuating the valve bridge. The valve bridge also has a second valve actuation area, which is spaced apart from the first valve actuation area, for example, especially in the longitudinal extension direction of the valve bridge. By actuating the valve bridge via the second valve actuation area, a second gas exchange valve of the internal combustion engine, which is provided especially in addition to the first gas exchange valve, can be actuated by means of the valve bridge. The actuating of the respective gas exchange valve can be understood, in particular, to mean that the gas exchange valve is moved from a closed position into an open position, in particular relative to the rocker lever axis and/or in translational motion, during or by the actuating of the respective gas exchange valve. For example, the respective gas exchange valve can be or is moved in the first direction of movement from the closed position to the open position. In particular, the respective gas exchange valve can be an outlet valve. Furthermore, it is preferably provided that the bridge actuation area is spaced apart from the respective valve actuation areas. Thus, the valve actuation areas and the bridge actuation area are preferably areas of the valve bridge that are spaced apart from each other and in particular different from each other, wherein the bridge actuation area, especially in the longitudinal extension direction of the valve bridge, is preferably arranged between the valve actuation areas. For example, the longitudinal extension direction of the valve bridge runs perpendicular to the first direction of movement.

In order to be facilitate a particularly simple maintenance and/or repair of the internal combustion engine which will in turn also be time-saving and cost-effective, it is provided in accordance with the invention that the valve bridge has a bridge center part forming the bridge actuation area, a first bridge part forming and thus having the first valve actuation area, and a guide part which projects from the bridge center part and from the first bridge part along a longitudinal extension direction of the bridge center part and the first bridge part extending perpendicularly to the first direction of movement and also referred to as the steering direction or spacing direction. The guide part can move with the first bridge part and the bridge center part. This is to be understood to mean especially that when the valve bridge is actuated and a resulting movement of the bridge center part and the first bridge part occurs, the guide part is moved along with the bridge center part and the first bridge part, and thus, for example, performs the same movement as the bridge center part and the first bridge part. In other words, for example, the feature that the guide part can move with the bridge center part and with the first bridge part means especially that relative movements between the bridge center part, the first bridge part and the guide part are omitted, i.e. are avoided or prevented. For example, the guide part is connected to the bridge center part and the first bridge part or is fixed to the bridge center part and the first bridge part, whereby relative movements between the bridge center part, the first bridge part and the guide part are avoided.

The valve bridge also has a second bridge part formed separately from the bridge center part, the first bridge part and separately from the guide part, which forms and thus has the second valve actuation area. Furthermore, the second bridge part has a reception orifice, also simply referred to as an opening and formed, for example, as a bore, into which the guide part engages. This means that the guide part is at least partially received in the reception orifice. In other words, at least a partial area of the guide part is arranged in the reception orifice and thus in the second bridge part, so that, for example, the second bridge part is arranged on the guide part, especially in a movable manner. Due to the fact that the guide part engages in the reception orifice and thus in the second bridge part, the second bridge part is held movably on the guide part at least along the steering direction or spacing direction (longitudinal extension direction) relative to the bridge center part, to the first bridge part and relative to the guide part, and is held on the bridge center part and the first bridge part via the guide part. In other words, in that the guide part engages in the reception orifice and thus in the second bridge part, the second bridge part is held on the guide part and via the guide part on the bridge center part and on the first bridge part, especially such that, by actuating the valve bridge, the valve bridge and thus on the bridge center part, the first bridge part, the guide part and the second bridge part can be moved in or along the first direction of movement, especially in translational motion. At the same time, the second bridge part, which is held on the guide part and via the guide part on the bridge center part and on the first bridge part, can be moved in translational motion along the longitudinal extension direction and thus along the guide part relative to the guide part, relative to the bridge center part and relative to the bridge part. This is to be understood especially as meaning that, while the guide part engages in the receptacle and thus while the second bridge part is held on the guide part and via the guide part on the bridge center part and on the first bridge part, the second bridge part can be displaced along the longitudinal extension direction relative to the guide part and thus relative to the bridge center part and to the first bridge part, especially can be displaced back and forth. When viewed the other way round, for example, the bridge center part, the first bridge part and the guide part form a structural unit which, due to the fact that the guide part engages in the receptacle, is partially arranged or received in the reception orifice and thus in the second bridge part and can be moved, moved in translational motion and thus displaced along the longitudinal extension direction relative to the second bridge part. The valve bridge is a component which has a simple embodiment in terms of construction and production technology, so that the valve bridge can be manufactured cost-effectively. By using the valve bridge according to the invention, particularly advantageous maintenance and/or repair of the internal combustion engine, also known as servicing, can be realized, since the valve bridge can be assembled and disassembled particularly easily. In particular, it is possible, for example, to avoid having to completely dismantle the valve train in order to access, for example, an attachment, in particular a screw connection, of an injector of the internal combustion engine arranged below the valve bridge. In particular, by using the valve bridge according to the invention, it can be avoided that the valve train has to be completely disassembled in order to create accessibility to the attachment of the injector. In particular, the valve bridge can be disassembled in a particularly simple and therefore time- and cost-saving manner in order to access the attachment of the injector, although the rest of the valve train does not have to be disassembled unduly. In addition, the valve bridge can be used for different valve distances, especially in the longitudinal extension direction of the valve bridge and thus along the longitudinal extension direction. Since the structural unit (bridge center part, first bridge part and guide part) and the second bridge part can be moved relative to one another along the longitudinal extension direction, specifically in translational motion, a distance between the valve actuation areas running along the longitudinal extension direction can, for example, be adjusted as required and thus varied, especially while the second bridge part is held on the guide part and via this on the bridge center part and on the first bridge part. In other words, a first value of the distance and a second value of the distance that differs from the first value can be set such that the distance or its values can be adapted to different valve distances as required. This means that the valve bridge or the same design variant of the valve bridge can be used for different valve distances.

The respective gas exchange valve is assigned to a gas channel of a cylinder head of the internal combustion engine, for example in the form of an outlet port or inlet port, whereby the respective gas exchange valve closes the respective assigned gas channel in its respective closed position. In the respective open position of the respective gas exchange valve, the respective gas exchange valve opens the respective assigned gas channel. The gas channels are assigned to the same cylinder of the internal combustion engine. Thus, for example, in the respective open position of the respective gas exchange valve, a gas comprising at least air, for example, can flow into the cylinder via the respective assigned gas channel (inlet port) and/or a gas initially absorbed in the cylinder, for example, can flow out of the cylinder via the respective assigned gas channel (outlet port) in the respective open position of the respective gas exchange valve. The aforementioned injector is designed, for example, to introduce a liquid fuel into the cylinder, especially to inject it directly into the cylinder. The injector is attached to the cylinder head, for example by means of the aforementioned attachment. In the complete and finished state of the internal combustion engine, for example, the attachment is overlapped or covered by the fully and completely assembled valve bridge such that the attachment cannot be accessed by a person who wishes to service or repair the internal combustion engine. In conventional internal combustion engines, the valve train or at least parts of the valve train must be disassembled, i.e. dismantled, in a time-consuming and costly process in order to access the attachment. As a result, the injector, for example, can be detached from the cylinder head and serviced, repaired or replaced.

Such extensive or complete disassembly of the valve bridge or the valve train can now be avoided by using the valve bridge according to the invention, whereby sufficient accessibility to the attachment can nevertheless be created in a particularly simple and cost-effective manner. Furthermore, the second bridge part can be or be held in a loss-proof manner on the guide part and via the guide part on the bridge center part and on the first bridge part, i.e. connected in a loss-proof manner to the guide part and via the guide part to the bridge center part and to the first bridge part, whereby the valve bridge can be assembled particularly easily and thus in a time-saving and cost-effective manner. In particular, the invention can prevent the bridge parts from becoming undesirably detached from one another, which makes the valve bridge particularly easy to handle and thus to assemble and disassemble. In particular, it is provided that the second bridge part is at least almost freely movable and/or displaceable on the guide part and is held or mounted via the guide part on the bridge center part and on the first bridge part, so that a particularly advantageous actuation of the gas exchange valves can be represented.

In order to facilitate a particularly simple maintenance and/or repair of the internal combustion engine, it is provided in one embodiment of the invention that the second bridge part is also held movably along the first direction of movement relative to the bridge center part, relative to the first bridge part and relative to the guide part on the guide part and via the guide part on the structural unit. This is realized, for example, such that the reception orifice has a first extension, especially height, running along the first direction of movement, wherein, for example, the partial area of the guide part engaging in the reception orifice and thus received in the reception orifice has a second extension, especially second height, running along the first direction of movement, wherein the second extension or the second height is less than the first extension or the first height. This allows the second bridge part to (also) be moved along the first direction of movement relative to the structural unit or, conversely, the guide part and thus the structural unit can be moved relative to the second bridge part along the first direction of movement. For this purpose, for example, the reception orifice is designed like an elongated bore, i.e. an elongated hole. The narrow sides of the elongated hole are closed off by semicircles that correspond to the width of the elongated hole. The longitudinal sides of the elongated hole run parallel to each other and along the first direction of movement.

A further embodiment is characterized by the fact that the reception orifice is designed as a through-hole-opening, which is completely penetrated by the guide part along the longitudinal extension direction. In particular, this means that the guide part protrudes along the longitudinal extension direction both on a first side of the second bridge part and on a second side of the second bridge part facing away from the first side along the longitudinal extension direction from the through-hole-opening and thus from the second bridge part. As a result, the second bridge part can be held particularly securely on the guide part, and the aforementioned distance between the valve actuation areas, which runs along the longitudinal extension direction, can be set particularly extensively and as required. This also makes the valve bridge particularly easy to install.

So as to be able to hold the structural unit and the second bridge part together in an especially secure manner and in turn to be able to mount the valve bridge particularly easily, it is provided in a further embodiment of the invention that the reception orifice is closed completely circumferentially along its circumferential direction running around the longitudinal extension direction. In particular, this means that the reception orifice is completely circumferential along the circumferential direction and thus uninterrupted by a wall of the second bridge part, which is designed, in particular, as a solid body and is preferably inherently rigid. This prevents the structural unit and the second bridge part from becoming undesirably detached from one another.

In order to be able to realize a particularly simple assembly of the valve bridge, it is provided in a further embodiment of the invention that the second bridge part is designed as a pin and the pin extends parallel to the first direction of movement and especially perpendicular to the longitudinal extension direction of the valve bridge. Preferably, the pin is formed on the outer circumference at least predominantly as a straight circular cylinder.

A further embodiment is characterized by the fact that the bridge center part and/or the first bridge part and/or the guide part are formed in one piece. As a result, the number of parts and thus the costs of the valve bridge can be kept to a minimum, and the valve bridge can be assembled and disassembled particularly easily.

Finally, it has been shown to be particularly advantageous if the guide part is formed in one piece with the bridge center part and with the first bridge part and is thereby connected to the bridge center part and to the first bridge part and can be moved along with the bridge center part and with the first bridge part. In other words, for example, the bridge center part, the first bridge part and the guide part are formed by an integral component. Again, in other words, the aforementioned structural unit is preferably formed in one piece, whereby the number of parts and thus the costs of the valve bridge can be kept low and a particularly simple assembly of the valve bridge can be presented.

A second aspect of the invention pertains to an internal combustion engine for a motor vehicle, in particular for an automobile and very preferably for a utility vehicle, which is preferably designed as a reciprocating piston engine or as a reciprocating piston motor and is also referred to as combustion motor. The internal combustion engine has a valve train which has a first gas exchange valve, a second gas exchange valve, a first rocker lever and a valve bridge common to the gas exchange valves, in particular according to the first aspect of the invention. The gas exchange valves can be actuated via the valve bridge by means of the first rocker lever, in particular simultaneously, and can thus be moved in translational motion, in particular simultaneously, in a first direction of movement. The valve bridge has a bridge actuation area, via which the valve bridge can be actuated by means of the first rocker lever and can thus be moved in translational motion in a first direction of movement. The valve bridge has a first valve actuation area, via which the first gas exchange valve can be actuated by means of the valve bridge when the valve bridge is actuated. The valve bridge has a second valve actuation area, via which the second gas exchange valve can be actuated by means of the valve bridge by actuating the valve bridge. In other words, if the valve bridge is actuated in the bridge actuation area and thus via the bridge actuation area by means of the first rocker lever, the valve actuation ranges are thereby actuated or the gas exchange valves are thereby actuated, especially opened, via the valve actuation areas.

In order to be facilitate a particularly simple maintenance and/or a particularly simple repair of the internal combustion engine, it is provided in the second aspect of the invention that the valve bridge has a bridge center part forming the bridge actuation area, a first bridge part forming a first valve actuation area, a first bridge part forming a second valve actuation area and a second bridge part forming a second valve actuation area, a guide part projecting from the first bridge part along a longitudinal extension direction extending perpendicularly to the first direction of movement of the bridge center part and of the first bridge part and movable together with the bridge center part and with the first bridge part, and a second bridge part formed separately from the bridge center part, separately from the first bridge part and separately from the guide part and forming the second valve actuation area. The second bridge part has a reception orifice in which the guide part engages, as a result of which the second bridge part is held on the guide part and, via the guide part, on the bridge center part and on the first bridge part so as to be movable at least along the longitudinal extension direction relative to the bridge center part, relative to the first bridge part and relative to the guide part. Advantages and advantageous embodiments of the first aspect of the invention are to be regarded as advantages and advantageous embodiments of the second aspect of the invention and vice versa.

It has been shown to be particularly advantageous if the internal combustion engine can be operated in an engine braking mode by means of the valve train and thus as an engine brake. The engine brake is preferably designed as a decompression brake, by means of which the motor vehicle can be braked particularly effectively and efficiently, i.e. its speed can be reduced, and/or it can be avoided that a speed at which the motor vehicle moves forward increases excessively.

Ultimately, it has been shown to be particularly advantageous if the valve train has a second rocker lever. The previous and following explanations regarding the first rocker lever can also be readily transferred to the second rocker lever and vice versa. The second bridge part is mounted or arranged to be movable, especially at least almost freely, such that in engine braking mode the second bridge part and thus the second gas exchange valve can be actuated by means of the second rocker lever, while the first gas exchange valve is not actuated. For example, the second rocker lever is arranged especially along the pivot axis next to the first rocker lever. For example, the second rocker lever is pivotably mounted on the rocker lever axis and can be pivoted about the pivot axis relative to the rocker lever axis. In particular, the two rocker levers can be pivoted about the pivot axis relative to each other and relative to the rocker lever axis. In particular, it is provided that the second gas exchange valve can be actuated via the second bridge part of the second valve actuation area by means of the second rocker lever, while the first gas exchange valve is not actuated. The valve train is designed, so that the first rocker lever interacts with the bridge actuation area and/or can be moved by pivoting the first rocker lever in interaction with the bridge actuation area, so that by actuating, in particular moving and more specifically pivoting, the first rocker lever, the valve bridge and thereby the valve actuation areas can be actuated via the bridge actuation area by means of the first rocker lever and can be moved in translational motion in the first direction of movement, whereby the gas exchange valves can be actuated, specifically simultaneously, and more specifically can be opened. Furthermore, the valve train is designed, for example, so that the second rocker lever interacts with a second valve actuation area, especially at a distance from the bridge actuation area, and/or can be brought into interaction with the second valve actuation area by pivoting the second rocker lever. Thus, for example, if the second rocker lever is actuated, especially moved and in particular pivoted, more specifically while the first rocker lever is not actuated, in particular moved, more specifically pivoted, the second bridge part of the valve actuation area and thus the second bridge part are actuated by means of the second rocker lever, such that the second gas exchange valve is actuated via the second valve actuation area while the first gas exchange valve is not actuated, that is, for example, while the first gas exchange valve remains in its closed position. As a result, in engine braking mode, for example, the second gas exchange valve can be actuated via the second bridge part by means of the second rocker lever, while the first gas exchange valve is not actuated, whereby the internal combustion engine can be operated as the engine brake. The second rocker lever is, for example, therefore also referred to as a brake rocker lever or engine brake rocker lever. In this respect, for example, the second bridge part of the second valve actuation area is movably mounted such that, when the second bridge part is actuated in relation to the rocker levers exclusively by means of the second rocker lever, the second bridge part moves along the first direction of movement and in particular relative to the guide part, that although the second gas exchange valve is actuated via the second bridge part by means of the second rocker lever, i.e. by pivoting the second rocker lever, the first gas exchange valve is not actuated and the bridge center part and the first bridge part of the valve bridge are at least largely not moved via the guide part. In particular, the second bridge part of the second valve actuation area moves relative to the guide part and thus to the first valve actuation area and the first bridge part. The relative movement of the second bridge part to the guide part means that the guide part accommodated in the second bridge part has a clearance in the first direction of movement, as a result of which the second bridge part can be moved in the first direction of movement by the second rocker lever without, or at least for the most part without, a movement of the guide part, for this purpose the second bridge part has the above-described reception orifice for the guide part in the form of an elongated hole. This allows the second gas exchange valve to be actuated via the second bridge part of the valve bridge by means of the second rocker lever, while the first gas exchange valve is not actuated. This makes engine braking mode particularly advantageous, especially particularly simple and cost-effective.

Further advantages, features and details of the invention can be seen from the following description of a preferred exemplary embodiment and from the drawing. The features and combinations of features mentioned above in the description as well as the features and combinations of features mentioned below in the description of the figures and/or shown alone in the figures can be used not only in the combination indicated in each case, but also in other combinations or on their own, without departing from the scope of the invention.

Figure 2:
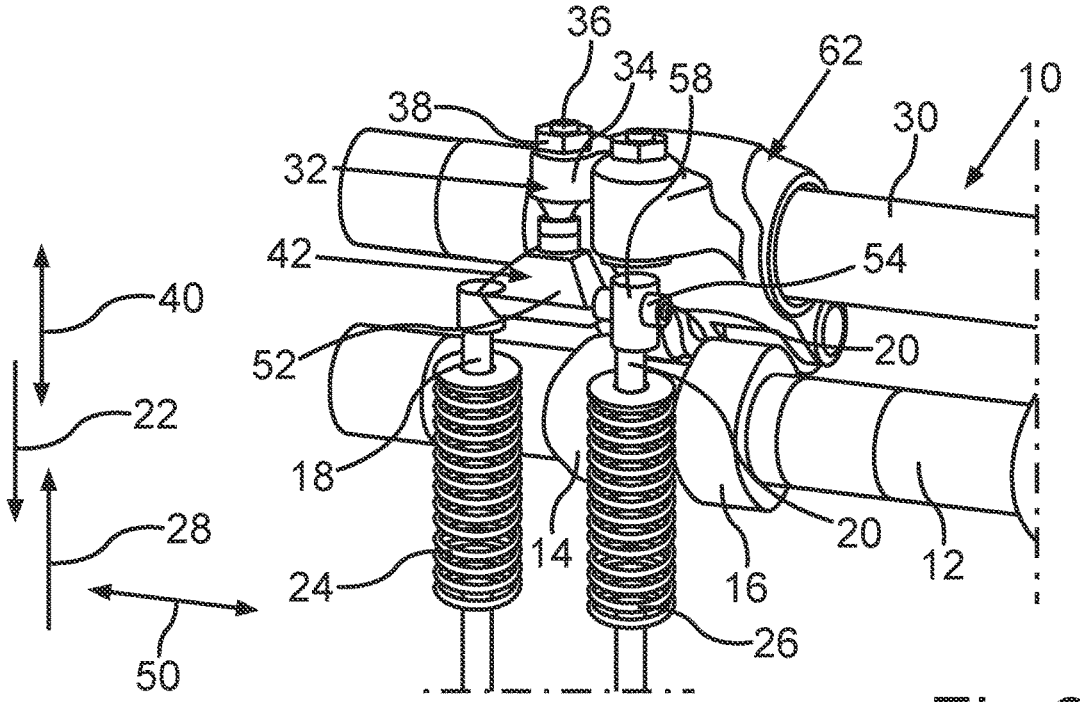
Figure 3:
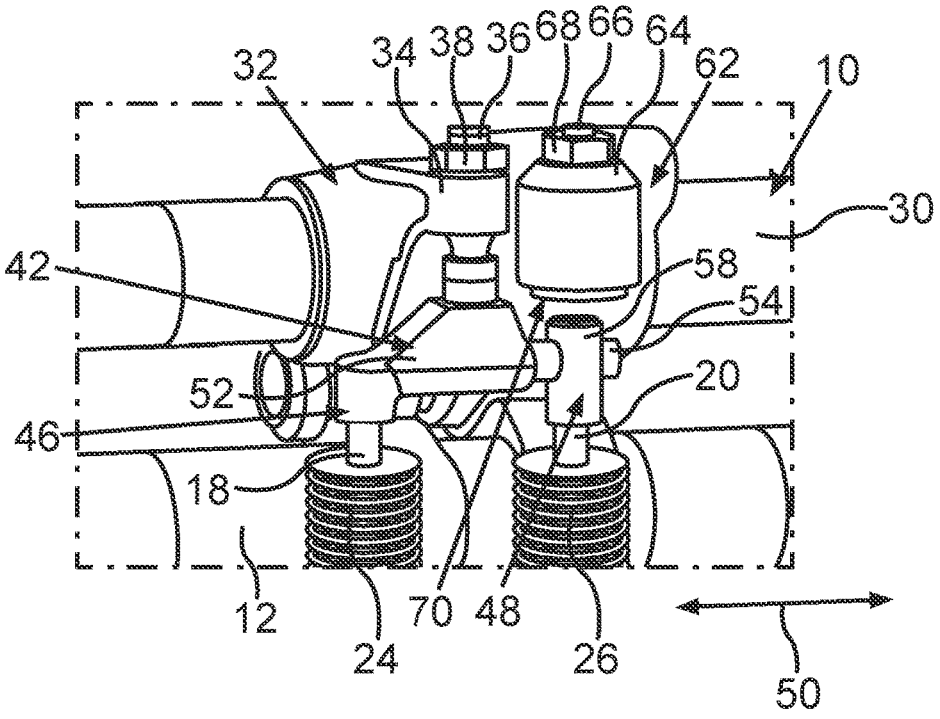
Figure 4:
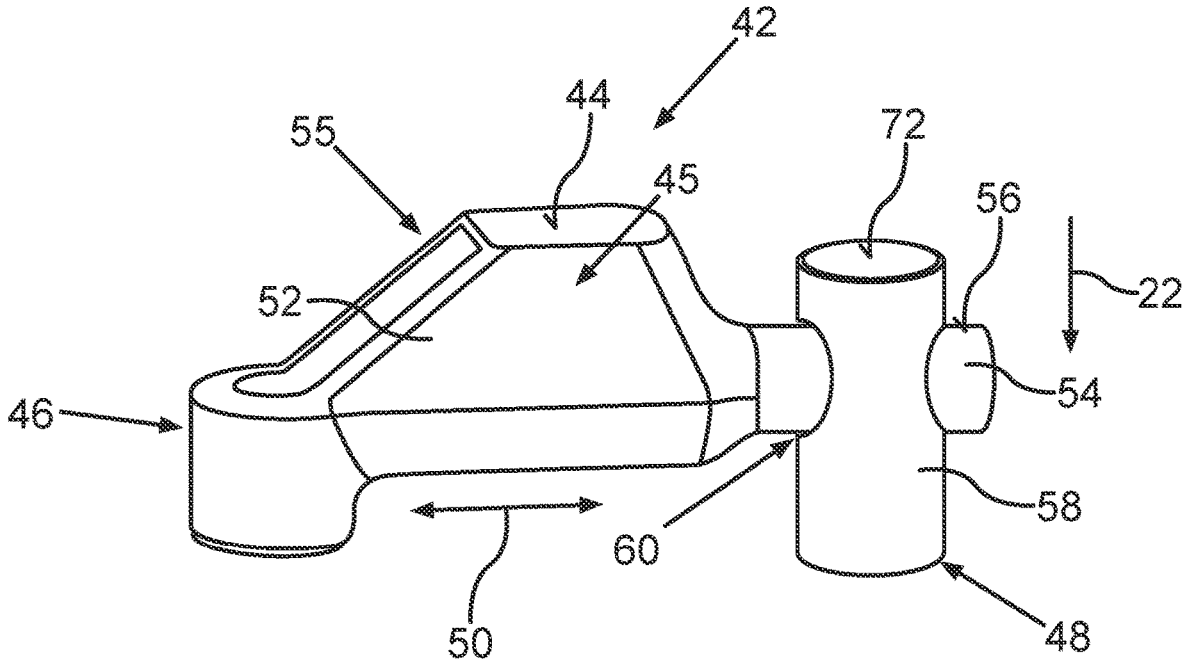
Figure 5:
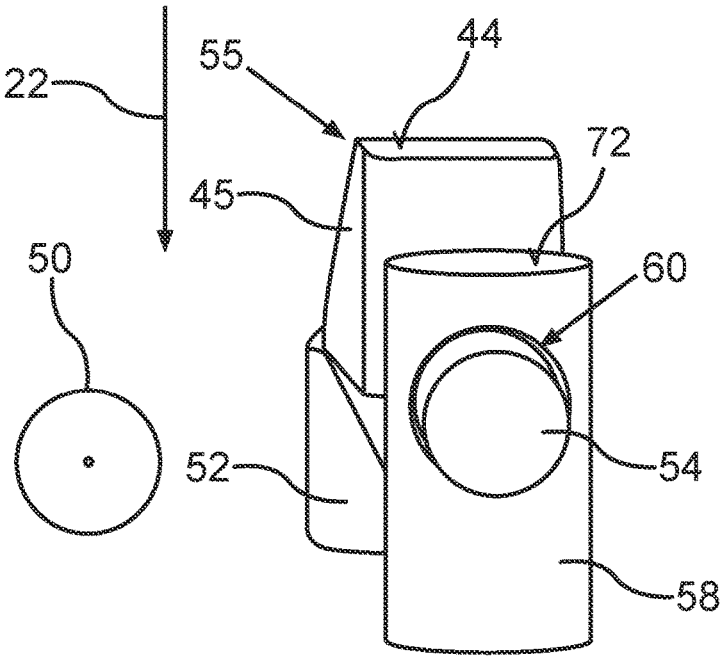

The drawing depicts as per:

FIG. 1 a schematic front view of a valve train for an internal combustion engine of a motor vehicle;

FIG. 2 a partial schematic perspective view of the valve train;

FIG. 3 a sectional view of a further schematic perspective view of the valve train;

FIG. 4 a schematic perspective view of a valve bridge of the valve train;

FIG. 5 a schematic and perspective side view of the valve bridge; and

Figure 6:
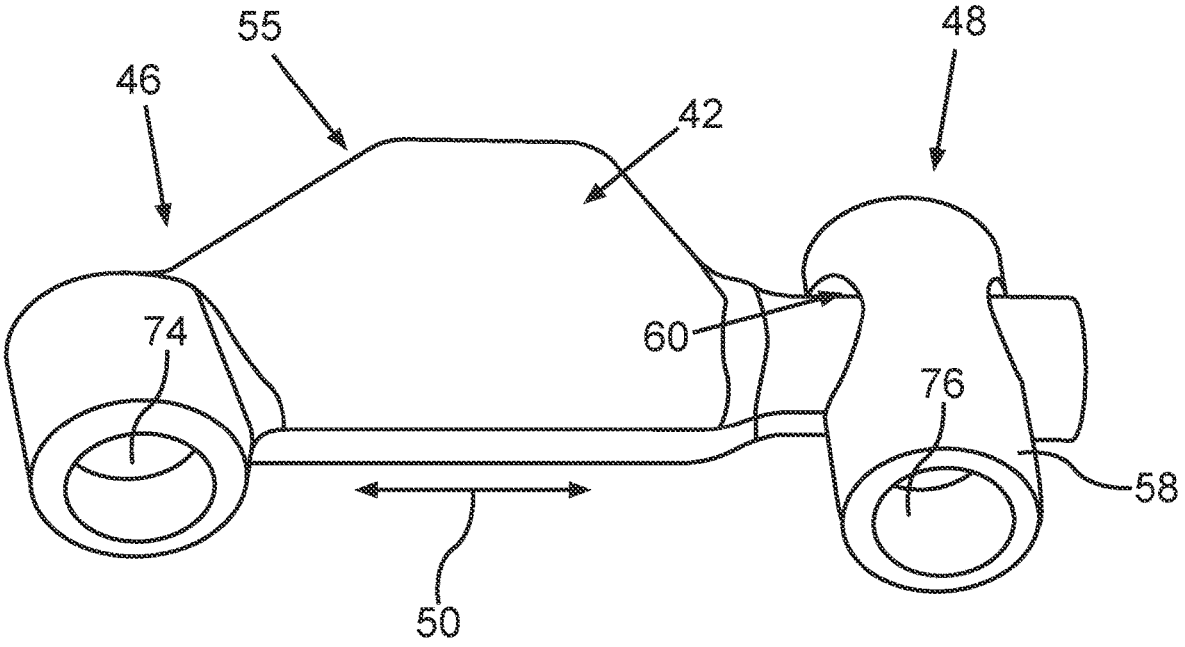

FIG. 6 a schematic and perspective bottom view of the valve bridge.

Identical or functionally identical elements are marked with the same reference signs in the figures.

FIG. 1 shows a schematic front view of a section of a valve train 10 of an internal combustion engine of a motor vehicle, which is preferably designed as a reciprocating piston motor or reciprocating piston engine and is also referred to as combustion motor. The motor vehicle is preferably designed as an automobile, in particular as a utility vehicle, and in its completely manufactured state comprises the internal combustion motor, also referred to as an internal combustion engine, by means of which the motor vehicle can be driven. The internal combustion engine, which is not shown in detail, has at least one cylinder in which combustion processes take place during operation of the internal combustion engine. The cylinder is formed, for example, by a crankcase of the internal combustion engine. In addition, the internal combustion engine comprises, for example, a cylinder head that is separate from the crankcase and connected to the crankcase, which forms a combustion chamber roof that is associated with the cylinder. The cylinder and the combustion chamber roof each partially form a combustion chamber. The combustion chamber is also partially formed by a piston, which is arranged in the cylinder so that it can move in translational motion.

The valve train 10 is shown as an example for the cylinder and has a camshaft 12 which is, for example, rotatably mounted on the cylinder head and thus rotatable about an axis of rotation relative to the cylinder head and which has a first cam 14 and a second cam 16. The valve train 10 also comprises a first gas exchange valve 18 and a second gas exchange valve 20, which are assigned to the same cylinder and are thus common to the aforementioned cylinder. The gas exchange valves 18 and 20 are designed, for example, as outlet valves. The respective gas exchange valve 18 or 20 is assigned a gas channel which is formed or limited by the cylinder head, for example, and which is an outlet port, for example. The respective gas exchange valve 18 or 20 can be moved, in particular in translational motion, between at least one closed position and at least one open position relative to the cylinder head. In the respective closed position, the respective gas exchange valve 18 or 20 closes the respective associated outlet port. In the respective open position, however, the respective gas exchange valve 18 or 20 releases the respective assigned outlet port, so that a gas initially absorbed in the cylinder can then flow out of the cylinder via the released outlet port. The respective gas exchange valve 18 or 20 can be moved in translational motion relative to the cylinder head in a first direction of movement from the respective closed position to the respective open position, as illustrated by an arrow 22 in FIG. 1. A valve spring 24 or 26 is assigned to the respective gas exchange valve 18 or 20. If the respective gas exchange valve 18 or 20 is moved from the respective closed position into the respective open position and thus moved relative to the cylinder head in the first direction of movement 22, the respective valve spring 24 or 26 is tensioned, in particular, compressed. As a result, the respective valve spring 24 or 26 provides a spring force which acts in a second direction of movement opposite to the first direction of movement 22 and illustrated in FIG. 1 by an arrow 28. By means of the respective spring force, the respective gas exchange valve 18 or 20 can be moved in translational motion in the second direction of movement 28 from the respective open position to the respective closed position and, in particular, can be held in the respective closed position.

The valve train 10 also has a rocker lever axis 30 and a first rocker lever 32. The first rocker lever 32 is also referred to as an exhaust rocker lever. The first rocker lever 32 comprises a base body 34, a setting element 36 in the form of an adjusting screw and a counter element 38 in the form of a lock nut. The setting element 36 can be moved in translational motion relative to the base body 34, for example along an adjusting direction illustrated in FIG. 1 by a double arrow 40 and running parallel to the first direction of movement 22 and parallel to the second direction of movement 28. As a result, the setting element can be moved along the adjusting direction 40 relative to the base body 34 into different positions or positions in which the setting element 36 is fixed or can be fixed relative to the base body 34 by means of the counter element 38. The setting element 36 is designed, for example, as an adjusting screw and is screwed into the base body 34. If, for example, the setting element 36 is rotated in a first rotational direction relative to the base body 34, the setting element 36 is thereby moved in translational motion relative to the base body 34 in the first direction of movement 22. If, for example, the setting element 36 is rotated relative to the base body 34 in a second rotational direction opposite to the first rotational direction, the setting element 36 is thereby moved in translational motion relative to the base body 34 in the second direction of movement 28 opposite to the first direction of movement 22. The counter element 38 (lock nut) is used, for example, to secure the setting element 36 (adjusting screw) against rotations relative to the base body 34 and thus against translational motion adjustments relative to the base body 34 and along the adjusting direction and relative to the base body 34. By means of the setting element 36, a valve clearance known per se can be set.

The valve train 10 also has a valve bridge 42 common to the gas exchange valves 18 and 20, which is particularly clearly recognizable from FIGS. 4 to 6. In this case, the gas exchange valves 18 and 20 can be actuated via the valve bridge 42, in particular simultaneously, by means of the first cam 14 via the first rocker lever 32 and can thus be moved in translational motion in the first direction of movement 22 relative to the cylinder head and relative to the rocker lever axis 30.

As can be seen particularly well in conjunction with FIGS. 4 to 6, the valve bridge 42 has a bridge actuation area 44, via which the valve bridge 42 can be actuated by means of the first rocker lever 32 and can thus be moved in translational motion in a direction parallel to the directions of movement 22 and 28 relative to the cylinder head and relative to the rocker lever axis 30. Furthermore, the valve bridge 42 has a first valve actuation area 46, which is spaced apart from the bridge actuation area 44, in particular in the longitudinal extension direction of the valve bridge 42. The longitudinal extension direction of the valve bridge 42 is illustrated by a double arrow 50 and runs perpendicular to the directions of movement 22 and 28. By actuating the valve bridge 42 via the first valve actuation area 46, in particular by actuating the valve bridge 42 via the bridge actuation area 44, the first gas exchange valve 18 can be actuated by means of the valve bridge 42 and thereby moved in translational motion in the first direction of movement 22 from the closed position into the open position of the first gas exchange valve 18 relative to the rocker lever axis 30 and relative to the cylinder head.

The valve bridge 42 also has a second valve actuation area 48, which is spaced apart from the valve actuation area 46 and from the bridge actuation area 44, in particular in the longitudinal extension direction 50 of the valve bridge 42. The longitudinal extension direction 50 runs perpendicular to the directions of movement 22 and 28 and perpendicular to the adjusting direction 40. By actuating the valve bridge 42, in particular by actuating the valve bridge 42 via the bridge actuation area 44, the second gas exchange valve 20 can be actuated by means of the valve bridge 42 via the second valve actuation area 48 and can thus be moved in translational motion in the first direction of movement 22 from the closed position into the open position of the second gas exchange valve 20 relative to the rocker lever axis 30 and relative to the cylinder head. The longitudinal extension direction 50 of the valve bridge 42 thus extends perpendicular to the gas exchange valves 18 and 20, whereby the bridge actuation area 44 is arranged or provided along the longitudinal extension direction 50 of the valve bridge 42 between the first valve actuation area 46 and the second valve actuation area 48 of the valve bridge 42.

An injector not shown in Fig. is also associated with the cylinder. By means of the injector, a fuel, in particular a liquid fuel, for operating the internal combustion engine can be introduced into the cylinder, in particular injected directly. The injector is attached to the cylinder head, preferably by means of an attachment designed as a screw connection. Since the attachment is designed as a screw connection, for example, the attachment is also referred to as an injector screw connection. For example, in the complete and finished state of the motor vehicle and thus of the internal combustion engine and, in particular, of the valve train 10, the attachment is overlapped or covered by the valve bridge 42, in particular in the upward direction of the vehicle and/or in the upward direction of the internal combustion engine. Thus, the attachment is not accessible to a person who wishes to service or repair the internal combustion engine when the internal combustion engine is complete and ready.

In order to create sufficient accessibility to the attachment in a particularly simple and therefore time- and cost-effective manner and, as a result, to be able to service and/or repair the internal combustion engine particularly easily and therefore time- and cost-effectively, the valve bridge 42 has a bridge center part 45 forming the bridge actuation area (44), a first bridge part 52 forming the first valve actuation area 46 and a guide part 54, which projects from the bridge center part 45 and from the first bridge part 52 along a line extending perpendicular to the first direction of movement 22 and in the longitudinal extension direction 50. In the exemplary embodiment shown in Fig., the guide part 54 is circular on the outer circumferential side and cylindrical in shape, so that the guide part 50 has the shape of a straight circular cylinder on the outer circumferential side, i.e. an outer circumferential lateral surface 56 of the guide part 54, the cylinder axis of which extends along the longitudinal extension direction 50, also referred to as the steering direction or spacing direction. The guide part 54 can be moved together with the bridge center part 45 and with the first bridge part 52. Thus, the bridge center part 45, the bridge part 52 and the guide part 54 form a structural unit 55 which is movable, in particular in the first direction of movement 22. It is conceivable that the bridge center part 45, the bridge part 52 and the guide part 54 are components which are formed separately from and firmly connected to one another, and which are firmly connected to one another such that relative movements between the components are prevented, i.e. are avoided. However, it has been shown to be particularly advantageous if the structural unit 55 is formed in one piece. This means that the guide part 54 is formed in one piece with the bridge center part 45 and with the bridge part 52, so that the bridge center part 45, the bridge part 52 and the guide part 54 are each formed in one piece on their own as a structural unit 55.

The valve bridge 42 also has a second bridge part 58, which is formed separately from the bridge center part 45, separately from the guide part 54 and separately from the bridge part 52 and forms the second valve actuation area 48, and which is formed in the present case as a pin. It can be seen particularly clearly from FIG. 5 that the second bridge part 58 (pin) has a reception orifice 60 in which the guide part 54 engages. For example, the reception orifice 60 is designed as an elongated hole. In the exemplary embodiment shown in Fig., the reception orifice 60 is a through-hole-opening which is completely penetrated by the guide part 54 along the longitudinal extension direction 50 (spacing direction). For example, the through-hole-opening is designed as a through-hole.

Due to the fact that the guide part 54 engages in the reception orifice 60 and thus in the second bridge part 58, the second bridge part 58 is movable in translational motion along the longitudinal extension direction 50 relative to the structural unit 55 and thus relative to the bridge center part 45, to the first bridge part 52 and relative to the guide part 54 and is held on the guide part 54 via the guide part 54 on the structural unit 55 and thus on the bridge center part 45 and on the first bridge part 52. This means that the bridge part 58 can be displaced along the longitudinal extension direction 50 relative to the structural unit 55 (bridge center part 45, bridge part 52 and guide part 54), can be in particular displaced back and forth, while the guide part 54 engages in the reception orifice 60, i.e., while the bridge part 58 is held on the structural unit 55, which means it is connected to the structural unit 55. In the present case, the second bridge part 58 is held, in particular mounted, on the pin (guide part 54) so as to be movable, in particular displaceable. By displacing the bridge part 58 relative to the structural unit 55 along the longitudinal extension direction 50, a distance between the valve actuation areas 46 and 48 extending along the longitudinal extension direction 50 can be adjusted, i.e. varied or changed. Furthermore, it can be seen from FIGS. 1 to 3 that the gas exchange valves 18 and 20 are arranged next to one another, i.e. in succession, in the axial direction of the rocker lever axis 30 and thus along the pivot axis. The axial direction of the rocker lever axis 30 and thus the pivot axis runs parallel to the longitudinal extension direction 50 and thus parallel to the longitudinal extension direction 50 of the valve bridge 42. By adjusting the distance between the valve actuation areas 46 and 48, the distance can be adapted to different valve distances between the gas exchange valves 18 and 20 extending in the axial longitudinal extension direction 50 of the rocker lever axis 30, so that the valve bridge 42 can be used for different valve distances.

It can be seen particularly clearly from FIG. 5 that in the exemplary embodiment shown in Fig. the reception orifice 60 is slot-shaped or designed as an elongated bore, which means it is designed as an elongated hole whose longitudinal extension direction runs, for example, along the direction of movement 22. Thus, for example, the reception orifice 60 is a slot-shaped through-hole. Furthermore, the reception orifice 60 is completely circumferentially closed along its circumferential direction extending around the longitudinal extension direction 50. Furthermore, the second bridge part 58 has a longitudinal extension direction which is parallel to the first direction of movement 22 and thereby perpendicular to the longitudinal extension direction 50 of the valve bridge 42. Preferably, the second bridge part 58 is formed in one piece.

The valve train 10 has a second rocker lever 62 provided in addition to the rocker lever 32, which is a brake rocker lever. As will be explained in more detail below, the second gas exchange valve 20 can be actuated via the second bridge part 58 of the second valve actuation area 48 by means of the second rocker lever 62, while the first gas exchange valve 18 is not actuated, i.e. while the gas exchange valve 18 remains in its closed position. As a result, the internal combustion engine can be operated in an engine braking mode and thus as an engine brake, which is preferably designed as a decompression brake known per se. For this purpose, the second rocker lever 62 comprises, analogous to the first rocker lever 32, a base body 64, a setting element 66 designed in the present case as an adjusting screw and a counter element 68 designed in the present case as a lock nut. Furthermore, the second rocker lever comprises a hydraulically actuated piston 70. By means of the setting element 66 and the lock nut 68, a clearance between the piston 70 and the second bridge part 58 can be adjusted in a manner known per se, analogous to the first rocker lever 32.

The valve bridge 42 has a brake actuation area 72, which is formed by the second bridge part 58. If the second rocker lever 62 is actuated by means of the second cam 16 (brake cam) in a manner known per se and thereby pivoted about the pivot axis relative to the rocker lever axis 30 and the piston 70 is extended out of the base body 64 in the first direction of movement 22, while actuation, i.e. pivoting, of the first rocker lever 32 is omitted, the second bridge part 58 is actuated by means of the second rocker lever 62 (brake rocker lever) via the actuation area 72, such that the second bridge part 58 is moved in the direction of movement 22, in particular in translational motion, whereby the second gas exchange valve 20 is actuated via the valve actuation area 48 by means of the second bridge part 58, because the bridge part 58 forms both the brake actuation area 72 and the second valve actuation area 48, so that the bridge part 58 of the second valve actuation area 48 is actuated via the valve actuation area 48 and the second gas exchange valve 20 is actuated via the same. However, when the second bridge part 58 is actuated by means of the second rocker lever 62 and via the brake actuation area 72, the gas exchange valve 18 is not actuated if the valve bridge 42 is not actuated by the rocker lever 32, which is preferably the case, because the second bridge part 58 is arranged or mounted with its reception orifice 60 on the guide part 54 so as to be at least almost freely movable so that when the second bridge part 58 is actuated by means of the second rocker lever 62 and thereby via the brake actuation area 72, the valve bridge 42 is not moved. Instead, only the second bridge part 58 and thus the second gas exchange valve 18 is moved during engine braking mode. The elongated hole (reception orifice 60) is dimensioned such that the second bridge part 58 can be moved in the first direction of movement 22 relative to the guide part 54 and thus to the structural unit 55 during braking operation without the valve bridge 42 as a whole and especially the structural unit 55 being moved as well.

It can be seen from FIG. 6 that the first bridge part 52 and the second bridge part 58 have a respective receptacle 74 or 76, in which the respective gas exchange valve 18 or 20, in particular a respective valve head of the respective gas exchange valve 18 or 20, engages and is therefore received. As a result, for example, the valve bridge 42 is arranged on the gas exchange valves 18 and 20 and, in particular, is held on these. This can prevent the valve bridge 42 from slipping off the gas exchange valves 18 and 20.

The valve bridge 42 according to the invention is particularly easy to remove without having to disassemble the valve train 10. If the second rocker lever 62 is not actuated by the second cam 16 and there is no braking operation with a hydraulically extended piston 72, a clearance between the piston 72 and the brake actuation area 72 of the second bridge part 58 can be increased to a maximum possible clearance by means of the setting element 66. Furthermore, the valve clearance between the bridge actuation area 44 and the first rocker lever 32 is maximized in a similar manner via the setting element 36. It is now possible to raise the valve bridge 42, in particular the structural unit 55, in the direction of the second direction of movement 28 and to further raise the first valve actuation area 46 in the direction of the second direction of movement 28, so that the receptacle 74 of the first valve actuation area 46 can be lifted away from the first gas exchange valve 18, as a result of which the structural unit 55 with the bridge center part 45, with the first bridge part 52 and the guide part 54 can be pivoted away from the rocker lever axis 30 and the guide part 54 with the structural unit 55 can be withdrawn from the reception orifice 60 of the second bridge part 58. The reception orifice 60 with its elongated hole is dimensioned such that it is possible to pivot the structural unit 55 and, in particular, the guide part 54 relative to the second bridge part 58 remaining on the second gas exchange valve 20.

| List of reference signs | |
|---|---|
| 10 | Valve train |
| 12 | Camshaft |
| 14 | first cam |
| 16 | second cam |
| 18 | first gas exchange valve |
| 20 | second gas exchange valve |
| 22 | first direction of movement |
| 24 | Valve spring |
| 26 | Valve spring |
| 28 | second direction of movement |
| 30 | Rocker lever axis |
| 32 | first rocker lever |
| 34 | Base body |
| 36 | Setting element |
| 38 | Counter element |
| 40 | Adjusting direction |
| 42 | Valve bridge |
| 44 | Bridge actuation area |
| 45 | Bridge center part |
| 46 | first valve actuation area |
| 48 | second valve actuation area |
| 50 | Longitudinal extension direction |
| 52 | first bridge part |
| 54 | Guide part |
| 55 | Structural unit |
| 56 | outer circumferential lateral surface |
| 58 | second bridge part |
| 60 | Reception orifice |
| 62 | second rocker lever |
| 64 | Base body |
| 66 | Setting element |
| 68 | Counter element |
| 70 | Piston |
| 72 | Brake actuation area |
| 74 | Receptacle |
| 76 | Receptacle |

The invention claimed is:

1. Valve bridge (42) for a valve train (10) of an internal combustion engine, having a bridge actuation area (44) via which the valve bridge (42) can be actuated by means of a first rocker lever (32) of the valve train (10) and can thereby be moved in translational motion in a first direction of movement (22), having a first valve actuation area (46) via which, by actuating the valve bridge (42), a first gas exchange valve (18) of the internal combustion engine can be actuated by means of the valve bridge (42), and with a second valve actuation area (48), via which a second gas exchange valve (20) of the internal combustion engine can be actuated by means of the valve bridge (42) by actuating the valve bridge, characterized in that the valve bridge (42) has a bridge center part (45) forming the bridge actuation area (44), a first bridge part (52) forming the first valve actuation area (46), a guide part (54) which projects from the bridge center part (45) and from the first bridge part (52) along a longitudinal extension direction (50) extending perpendicularly to the first direction of movement (22) and which can be moved together with the bridge center part (45) and with the first bridge part (52), and a second bridge part (58) formed separately from the bridge center part (45), separately from the first bridge part (52) and separately from the guide part (54) and forming the second valve actuation area (48), which has a reception orifice (60) in which the guide part (54) engages, as a result of which the second bridge part (58) is held on the guide part (54) and, via the guide part (54), on the bridge center part (45) and on the first bridge part (52) so as to be movable at least along the longitudinal extension direction (50) relative to the bridge center part (45) and relative to the first bridge part (52) and relative to the guide part (54).

2. Valve bridge (42) according to claim 1,
characterized in that
the second bridge part (58) is also held movably along the first direction of movement (22) relative to the bridge center part (45), relative to the first bridge part (52) and relative to the guide part (54) on the guide part (54) and via the guide part (54) on the bridge center part (45) and on the first bridge part (52).

3. Valve bridge (42) according to claim 1,
characterized in that
the reception orifice (60) is designed as a through-hole-opening which is completely penetrated by the guide part (54) along the longitudinal extension direction (50).

4. Valve bridge (42) according to claim 1,
characterized in that
the reception orifice (60) is completely closed circumferentially along its circumferential direction running around the longitudinal extension direction (50).

5. Valve bridge (42) according to claim 1,
characterized in that
the second bridge part (58) is designed as a pin whose longitudinal extension direction runs parallel to the first direction of movement (22).

6. Valve bridge (42) according to claim 1,
characterized in that
the bridge center part (45) and/or the first bridge part (52) and/or the guide part (54) is formed in one piece.

7. Valve bridge (42) according to claim 1,
characterized in that
the guide part (54) is formed in one piece with the bridge center part (45) and with the first bridge part (52) as a structural unit (55) and is thereby connected to the bridge center part (45) and to the first bridge part (52) and can be moved along with the bridge actuation area (44) and with the first bridge part (52).

8. Internal combustion engine for a motor vehicle, having a valve train (10) which has a first gas exchange valve (18), a second gas exchange valve (20), a first rocker lever (32) and a valve bridge (42) which is common to the gas exchange valves (18, 20) and via which the gas exchange valves (18, 20) can be actuated by means of the first rocker lever (32) and can thereby be moved in translational motion in a first direction of movement (22), the valve bridge (32) having a bridge actuation area (44), via which the valve bridge (42) can be actuated by means of the first rocker lever (32) and can thereby be moved in translational motion parallel to the first direction of movement (22), a first valve actuation area (46) via which the first gas exchange valve (18) can be actuated by means of the valve bridge (42) by actuating the valve bridge (42), and a second valve actuation area (48), via which the second gas exchange valve (20) can be actuated by means of the valve bridge (42) by actuating the valve bridge (42), characterized in that the
valve bridge (42) has a bridge center part (45) forming the bridge actuation area (44), a first bridge part (52) forming the first valve actuation area (46), a guide part (54) projecting from the bridge center part (45) and from the first bridge part (52) along a longitudinal extension direction (50) extending perpendicularly to the first direction of movement (22) from the bridge center part (45) and from the first bridge part (52) and movable with the bridge center part (45) and with the first bridge part (52), and a second bridge part (58) formed separately from the bridge center part (45), separately from the first bridge part (52) and separately from the guide part (54) and forming the second valve actuation area (48), which has a reception orifice (60) in which the guide part (54) engages, as a result of which the second bridge part (58) is held on the guide part (54) and, via the guide part (54), on the bridge center part (45) and on the first bridge part (52) so as to be movable at least along the longitudinal extension direction (50) relative to the bridge center part (45) and relative to the first bridge part (52) and relative to the guide part (54).

9. Internal combustion engine according to claim 8,
characterized in that
the internal combustion engine can be operated in an engine braking mode by means of the valve train (10) and thereby as an engine brake.

10. Internal combustion engine according to claim 9,
characterized by
a second rocker lever (62), wherein the second bridge part (58) is movably mounted such that in the engine braking mode the second bridge part (58) and thereby the second gas exchange valve (20) can be actuated by means of the second rocker lever (62), while the first gas exchange valve (18) is not actuated.

* * * * *